US012698611B2

(12) United States Patent
Overkamp

(10) Patent No.: US 12,698,611 B2
(45) Date of Patent: Aug. 4, 2026

(54) PILE DRIVING DEVICE AND A FOLLOWER

(71) Applicant: IQIP HOLDING B.V., Sliedrecht (NL)

(72) Inventor: Patrick Ingmar Overkamp, Dordrecht (NL)

(73) Assignee: IQIP HOLDING B.V., Sliedrecht (NL)

( * ) Notice: Subject to any disclaimer, the term of this patent is extended or adjusted under 35 U.S.C. 154(b) by 46 days.

(21) Appl. No.: 18/682,301

(22) PCT Filed: Aug. 10, 2022

(86) PCT No.: PCT/NL2022/050464
§ 371 (c)(1),
(2) Date: Feb. 8, 2024

(87) PCT Pub. No.: WO2023/018329
PCT Pub. Date: Feb. 16, 2023

(65) Prior Publication Data

US 2024/0344291 A1 Oct. 17, 2024

(30) Foreign Application Priority Data

Aug. 11, 2021 (NL) ..... 2028956

(51) Int. Cl.
*E02D 13/10* (2006.01)
*E02D 7/02* (2006.01)
*E02D 7/06* (2006.01)

(52) U.S. Cl.
CPC ..... *E02D 13/10* (2013.01); *E02D 7/06* (2013.01); *E02D 2600/30* (2013.01)

(58) Field of Classification Search
CPC .. E02D 13/00; E02D 7/06; E02D 7/02; E02D 7/04; E02D 13/10
See application file for complete search history.

(56) References Cited

U.S. PATENT DOCUMENTS 1,023,243 A 4/1912 Clark
1,831,209 A 11/1931 Thornley et al.
(Continued)

FOREIGN PATENT DOCUMENTS

CN 212026252 U 11/2020
DE 3634905 A1 4/1988
(Continued)

OTHER PUBLICATIONS

International Search Report and Written Opinion in corresponding International Application No. PCT/NL2022/050464 dated Sep. 26, 2022.
(Continued)

*Primary Examiner* — Gloria R Weeks
(74) *Attorney, Agent, or Firm* — Steven M. Koehler; Westman, Champlin & Koehler, P.A.

(57) ABSTRACT

A pile driving device for driving a pile into the ground comprises a ram, an anvil and a sleeve. The anvil is accommodated in the sleeve and movable with respect to the sleeve in a driving direction. The ram is reciprocatingly movable with respect to the anvil in the driving direction so as to provide impact energy to the anvil under operating conditions. The anvil and the sleeve contact each other in transverse direction of the driving direction through an anvil guide surface of an anvil guide. The anvil guide is a separate anvil guide that is mounted to one of the anvil and the sleeve such that the anvil guide surface is movable with respect to said one of the anvil and the sleeve in the transverse direction.

10 Claims, 9 Drawing Sheets

(56) References Cited

U.S. PATENT DOCUMENTS 2,385,439 A * 9/1945 Gubbins ..... B25D 17/06 173/124
2,904,964 A 9/1959 Kupka
3,071,994 A * 1/1963 Swenson ..... B25C 1/02 173/132
3,597,930 A 8/1971 Rochelle et al.
3,747,690 A * 7/1973 Deike ..... E02D 3/046 173/121
3,788,402 A * 1/1974 Chelminski ..... E02D 11/00 173/127
3,866,692 A * 2/1975 Stelljes ..... F16D 7/044 173/133
3,991,833 A * 11/1976 Ruppert ..... E02D 13/10 173/131
4,029,158 A * 6/1977 Gerrish ..... E02D 7/26 267/113
4,036,310 A * 7/1977 Schnell ..... E02D 13/10 52/125.5
4,072,199 A * 2/1978 Wanner ..... B25D 17/08 173/133
4,102,410 A * 7/1978 Ross ..... B25D 17/08 173/133
4,119,159 A * 10/1978 Arentsen ..... E02D 13/10 173/133
4,226,287 A * 10/1980 Jansz ..... E02D 7/02 173/126
4,310,055 A * 1/1982 Wanner ..... B25D 17/06 173/118
4,366,870 A * 1/1983 Frederick ..... E02D 13/10 173/210
4,408,668 A * 10/1983 Kuhn ..... E02D 13/10 173/128
4,457,499 A * 7/1984 Townsend ..... E02D 13/10 267/137
4,465,145 A * 8/1984 Kuhn ..... E02D 13/10 173/1
4,702,325 A 10/1987 Hipp
4,989,677 A * 2/1991 Lam ..... E02D 5/523 173/1
5,110,237 A * 5/1992 Hesse ..... E02D 13/10 405/184
5,117,924 A * 6/1992 Bermingham ..... E02D 13/10 173/210
5,174,386 A * 12/1992 Crover ..... E02D 7/06 173/132
5,375,664 A * 12/1994 McDowell ..... E02D 7/18 173/147
5,379,848 A * 1/1995 Rauser ..... B25D 16/003 173/48
5,449,253 A 9/1995 Roger
6,000,477 A * 12/1999 Campling ..... E02D 7/10 173/100
6,224,294 B1 5/2001 Mansfield
6,364,577 B1 * 4/2002 Haney ..... E02D 13/10 405/228
7,104,731 B2 * 9/2006 Mohr ..... E02D 13/10 173/128
7,775,304 B2 8/2010 Luo
8,230,943 B2 * 7/2012 Felger ..... B25D 16/006 227/118
8,434,969 B2 * 5/2013 White ..... E02D 5/285 405/249
9,206,577 B2 * 12/2015 Lusk ..... E02D 7/04
10,190,282 B2 * 1/2019 Van Vessem ..... E02D 7/02
11,498,196 B2 * 11/2022 Ebner ..... B25D 17/005
2002/0108766 A1 * 8/2002 Plank ..... B25D 17/06 173/171
2002/0139551 A1 * 10/2002 Mewes ..... E02D 13/10 173/114
2004/0146364 A1 * 7/2004 Mohr ..... E02D 13/10 405/249
2011/0299938 A1 * 12/2011 Jung ..... E02D 13/00 405/232
2012/0107053 A1 5/2012 Baumfalk
2012/0107054 A1 5/2012 Baumfalk
2012/0107055 A1 5/2012 Baumfalk
2014/0262393 A1 * 9/2014 Desmeules ..... E02D 7/06 173/171
2014/0262399 A1 * 9/2014 Cunningham ..... E04H 17/263 173/133
2018/0087233 A1 3/2018 Van Vessem et al.
2021/0301593 A1 * 9/2021 Mcmillan ..... E21B 1/14
2022/0349144 A1 * 11/2022 Winkes ..... E02D 7/14

FOREIGN PATENT DOCUMENTS

EP 0581688 A1 2/1994
EP 0984105 A1 3/2000
EP 1085130 A2 3/2001
EP 1433903 B1 7/2008
EP 2481490 A1 8/2012
GB 1089717 A 11/1967
GB 2472665 B 7/2014
JP S56-150215 A 11/1981
JP S59-102016 A 6/1984
JP H06272250 A 9/1994

OTHER PUBLICATIONS

Office action in corresponding Japanese patent application serial No. 2024-507918 dated Apr. 28, 2026.

* cited by examiner

PILE DRIVING DEVICE AND A FOLLOWER

CROSS-REFERENCE TO RELATED APPLICATION(S)

This Application is a Section 371 National Stage Application of International Application No. PCT/NL2022/050464, filed Aug. 10, 2022 and published as WO 2023/018329 A1 on Feb. 16, 2023, in English and further claims priority to Netherlands application no. 2028956, filed Aug. 11, 2021, which are hereby incorporated by reference in their entirety.

BACKGROUND

The present invention relates to a pile driving device for driving a pile into the ground, comprising a ram, an anvil and a sleeve, wherein the anvil is accommodated in the sleeve and movable with respect to the sleeve in a driving direction, wherein the ram is reciprocatingly movable with respect to the anvil in the driving direction so as to provide impact energy to the anvil under operating conditions, wherein the anvil and the sleeve contact each other in transverse direction of the driving direction through an anvil guide surface of an anvil guide.

Such a pile driving device is known from EP 1 433 903. When a pile, such as a monopile for supporting a wind turbine, is to be driven into the ground the driving device is located with respect to the pile such that the anvil rests on top of the pile, whereas a lower portion of the sleeve in which the anvil is located surrounds an upper portion of the pile. A portion of the sleeve forms the anvil guide and the inner wall thereof forms the anvil guide surface. Under operating conditions the ram repeatedly strikes onto the anvil. When the ram provides impact energy to the anvil the anvil and the pile are initially lowered in the driving direction with respect to the sleeve. The sleeve will follow the movement such that during repeated strikes the anvil reciprocatingly moves in the driving direction with respect to the sleeve.

A strike of the ram onto the anvil may result in temporarily bending of the anvil, which may lead to deformation of the anvil in the transverse direction. For example, in practice a radial expansion of a few mm may occur. At the same time the anvil can move a few cm within the sleeve due to compression of the pile and penetration of the pile into the ground. Usually, this effect increases with increasing ratios between the size of the anvil and the size of the ram in the transverse direction. For example, diameters of monopiles for off-shore wind turbines are increasing, which leads to increased diameters of anvils, hence increasing ratios between the diameters of the anvil and the ram in case of using similar rams. Another issue is that the contact force between the sleeve and the anvil may be locally increased at the anvil guide surface due to an eccentric location of the anvil within the sleeve, for example due to tight installation clearances. Consequently, a high contact force may arise at the anvil guide surface, which can lead to temperature increase at the anvil guide surface and energy loss due to increased friction between the anvil and the sleeve. It appears that this can result in wear, for example in the form of galling. Besides, energy loss means that less energy is transferred from the ram to the pile under operating conditions.

SUMMARY

A pile driving device is disclosed having an anvil guide that is a separate anvil guide that is mounted to one of the anvil and the sleeve such that the anvil guide surface is movable with respect to the one of the anvil and the sleeve in the transverse direction.

Since the guide surface is movable with respect to the one of the anvil and the sleeve the contact stress between the sleeve and the anvil can be lowered if it tends to become too high. This provides the opportunity to minimize wear of the anvil guide surface and a counter surface thereof.

In practice the pile driving device may be configured such that under operating conditions when the anvil is placed directly or indirectly onto a pile to be driven into the ground the ram repeatedly strikes onto the anvil and the anvil reciprocatingly moves with respect to the sleeve in the driving direction. Usually, the driving direction is vertical, but it may also be inclined with respect to the vertical. If the anvil is placed indirectly onto the pile a follower may be disposed between the anvil and the pile. Furthermore, the size of the anvil may be larger than the size of the ram in the transverse direction. The ram and the anvil may have circular cross-sections; in this case the diameter of the anvil may be larger than the diameter of the ram. Preferably, the length of the anvil guide as measured in the driving direction is the same or larger than the maximum stroke of the anvil within the sleeve, for example larger than the thickness of the anvil as measured in the driving direction.

The anvil guide may comprise an elasticity for allowing the anvil guide surface to move, which elasticity has an elastic modulus which is smaller than the elastic modulus of the anvil or of the sleeve in the transverse direction at the location of the anvil. This means that it is easier to displace the anvil guide surface than the anvil or the sleeve in the transverse direction where the anvil is located. The elasticity may also allow the anvil guide surface to change its orientation, for example due to bending of the anvil and to allow the anvil guide surface to move if the anvil is positioned eccentrically in the sleeve.

In a preferred embodiment the anvil guide surface is part of a rigid anvil guide body, which is resiliently mounted to the one of the anvil and the sleeve, since contact forces may be quite high in practice. For example, the rigid anvil guide body may be made of steel. The sleeve and the anvil may also be made of steel such that there is a steel-on-steel contact at the anvil guide surface.

In a particular embodiment the anvil guide is a discrete anvil guide element, wherein one or more of such discrete anvil guide elements are located at a distance from each other in circumferential direction of the anvil. The anvil guide elements may be equally distributed in the circumferential direction.

In a practical embodiment the anvil guide is mounted to the sleeve such that the anvil guide surface is movable with respect to the sleeve in the transverse direction. This provides the opportunity to mount the anvil guide such that it can be replaced from the outside of the sleeve such that in case of replacement of the anvil guide the anvil may remain inside the sleeve.

The sleeve may also be provided with a pile guide element for guiding a pile to be driven into the ground, which pile guide element is displaceable with respect to the sleeve in transverse direction of the driving direction so as to vary its rate of protrusion within the sleeve. This is advantageous in case of using the pile driving device in case of piles of different sizes in cross-section, for example different diameters.

In an alternative embodiment a further anvil guide is mounted to the anvil such that the further anvil guide is movable with respect to the anvil in the transverse direction wherein the further anvil guide has similar functional characteristics as the anvil guide. In this case, the sleeve is provided with the pile guide element and the anvil is provided with the further pile guide element. This minimizes wear and tear of the anvil and the sleeve, resulting in a long operational life of these parts and significant cost reduction. The anvil guide and the further anvil guide may be located at different positions in the driving direction and/or in circumferential direction about the centerline of the sleeve. The further anvil guide may be the same as the anvil guide.

Furthermore, the pile driving device may be provided with sensors for monitoring the actual status of the parts such that the remaining life span of the parts can be assessed regularly.

Preferably, the pile driving device comprises a blocking mechanism for blocking the pile guide element with respect to the sleeve in the driving direction, since this minimizes the risk of vibration of the pile guide element in a direction parallel to the centerline of the sleeve during pile driving, which might lead to damage of the pile guide element and/or the sleeve.

In a practical embodiment the blocking mechanism is provided with a wedge, which is movable in the transverse direction so as to allow blocking and releasing the pile guide element with respect to the sleeve in the driving direction. In case of a sleeve including a circular cross-section the wedge may be movable in radial direction of the sleeve.

The blocking mechanism may be operable from an outer side of the sleeve such that it is easily accessible for operators.

It is noted that the displaceable pile guide element is not necessarily in combination with the anvil guide. In other words, the invention is also related to the following aspects:

Aspect 1: A pile driving device for driving a pile into the ground, comprising a ram, an anvil and a sleeve, wherein the anvil is accommodated in the sleeve and movable with respect to the sleeve in a driving direction, wherein the ram is 10 reciprocatingly movable with respect to the anvil in the driving direction so as to provide impact energy to the anvil under operating conditions, wherein the sleeve is provided with a pile guide element for guiding a pile to be driven into the ground, which pile guide element is displaceable with respect to the 15 sleeve in a transverse direction of the driving direction so as to vary its rate of protrusion within the sleeve.

Aspect 2: A pile driving device according to aspect 1, wherein the pile driving device comprises a blocking mechanism for blocking the pile guide element with respect to the sleeve in the driving direction.

Aspect 3: A pile driving device according to aspect 2, wherein the blocking mechanism is provided with a wedge, which is movable in the transverse direction so as to allow blocking and releasing the pile guide element with respect to the sleeve in the driving direction.

Aspect 4: A pile driving device according to aspect 2 or 3, wherein the blocking mechanism is operable from the outside of the sleeve.

The invention is also related to a follower for use in combination with a pile driving device as described above, wherein the follower is suitable to be placed onto a pile such that the anvil is placed indirectly onto the pile through the follower under operating conditions, wherein the follower is a tubular follower including a centerline which is directed in the same direction as the driving direction, wherein the follower is provided with stress relieve slots which are located at a circumference of the follower, wherein the longitudinal directions of the stress relieve slots are parallel to the centerline of the follower.

The stress relieve slots are also used for receiving lifting elements in order to enable hoisting of the follower, for example lifting pins or a lifting beam.

Preferably, each of the stress relieve slots has opposite longitudinal walls which are concave, since this appears to be advantageous in terms of relatively low stress concentrations in the follower.

For example, each of the longitudinal walls may have at least a section which coincides with a section of an ellipse.

A further improvement in terms of relatively low stress concentrations is obtained when an upper rim of the follower, onto which the anvil provides impact energy under operating conditions, has sunken portions at positions where the stress relieve slots are located. This means that under operating conditions the slots are located below the sunken or depressed portions at the upper rim of the follower.

The slots may be located closer to an upper end of the follower, which receives impact energy from the anvil under operating conditions, than to a lower end of the follower.

BRIEF DESCRIPTION OF THE DRAWINGS

Aspects of the invention will hereafter be elucidated with reference to schematic drawings illustrating embodiments of the invention by way of example.

DETAILED DESCRIPTION OF THE ILLUSTRATIVE EMBODIMENTS

Figure 1:
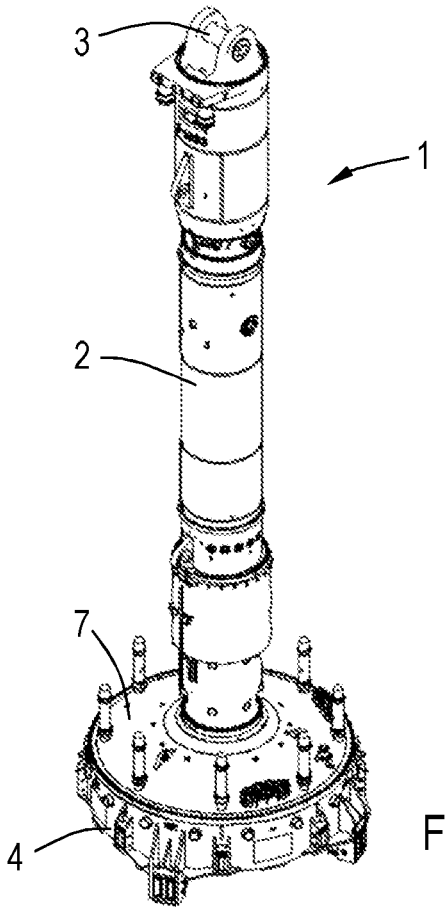
FIG. 1 is a perspective view of an embodiment of a pile driving device.

FIG. 1 shows an embodiment of a pile driving device 1 for driving a pile (not shown) into the ground according to the invention. The pile may be a circular-cylindrical monopile which may serve as a foundation for a wind turbine after its installation. The pile driving device 1 is provided with a hydraulic driver 2 comprising a ram (not shown). A hoisting bar 3 is provided on top of the hydraulic driver 2 in order to be able to lift the pile driving device 1, for example by means of a crane.

The pile driving device 1 is also provided with a sleeve 4. A part of the sleeve 4 is shown FIG. 2 and a plan view of that part is shown in FIG. 3. FIGS. 5-13 show further details of the pile driving device 1. The sleeve 4 accommodates an anvil 5 that is partly shown in FIG. 4. The sleeve 4 surrounds the anvil 5. It also surrounds an upper end of a pile to be driven into the ground in which situation the anvil 5 rests directly or indirectly on top of the pile. The anvil 5 serves to transmit impact energy from the ram to the pile under operating conditions and is movable with respect to the sleeve 4 in a driving direction along a centerline CL of the sleeve 4. In the embodiment as shown in FIG. 4 the anvil 5 is a circular plate which has a diameter that is larger than the diameter of the ram. The sleeve 4 has a substantially circular cross-section. An upper end of the sleeve 4 is closed by a cover 7, which has a central opening through which the ram can pass in order to strike onto the anvil 5. The hydraulic driver 2 and the sleeve 4 are mounted to each other through the cover 7. The anvil 5 and the sleeve 4 may be made of steel.

Under operating conditions, when the anvil 5 is placed onto a pile to be driven into the ground the ram repeatedly strikes onto the anvil 5 in the driving direction and the anvil 5 reciprocatingly moves with respect to the sleeve 4 in the driving direction due to the following phenomenon. Each time when the ram strikes onto the anvil 5 the anvil 5 and the pile are initially lowered in the driving direction with respect to the sleeve 4 after which the sleeve 4 follows that movement in downward direction.

Figure 2:
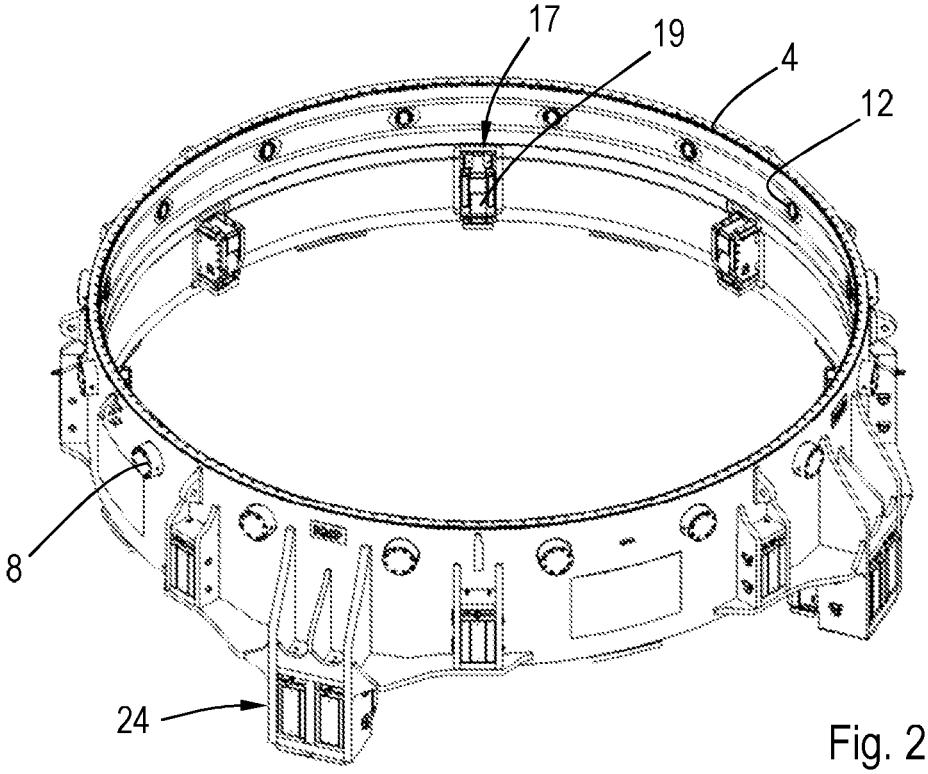
FIG. 2 is a similar view as FIG. 1, showing a part thereof on a larger scale.
Figure 3:
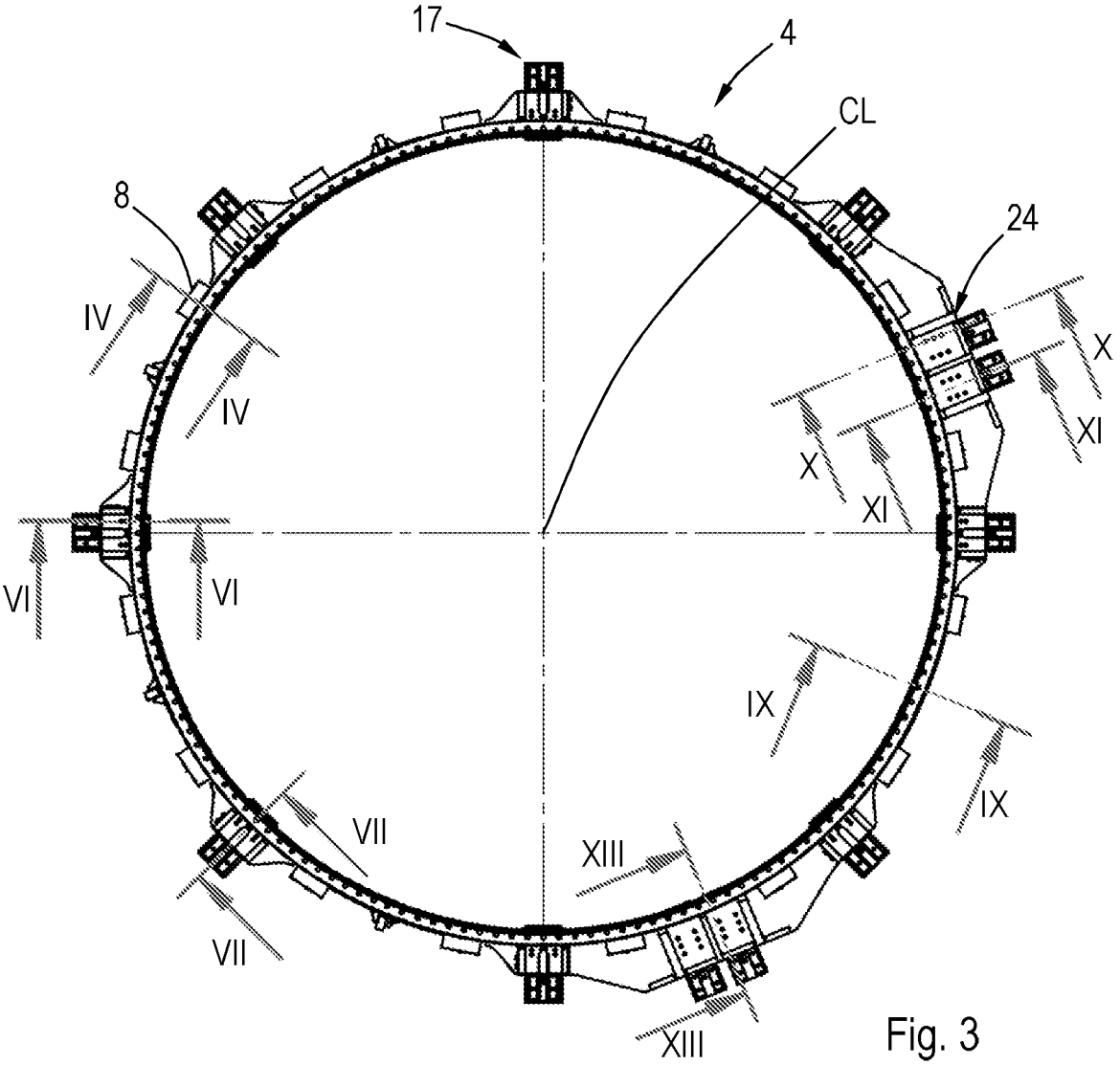
FIG. 3 is a plan view of the part as shown in FIG. 2.
Figure 4:
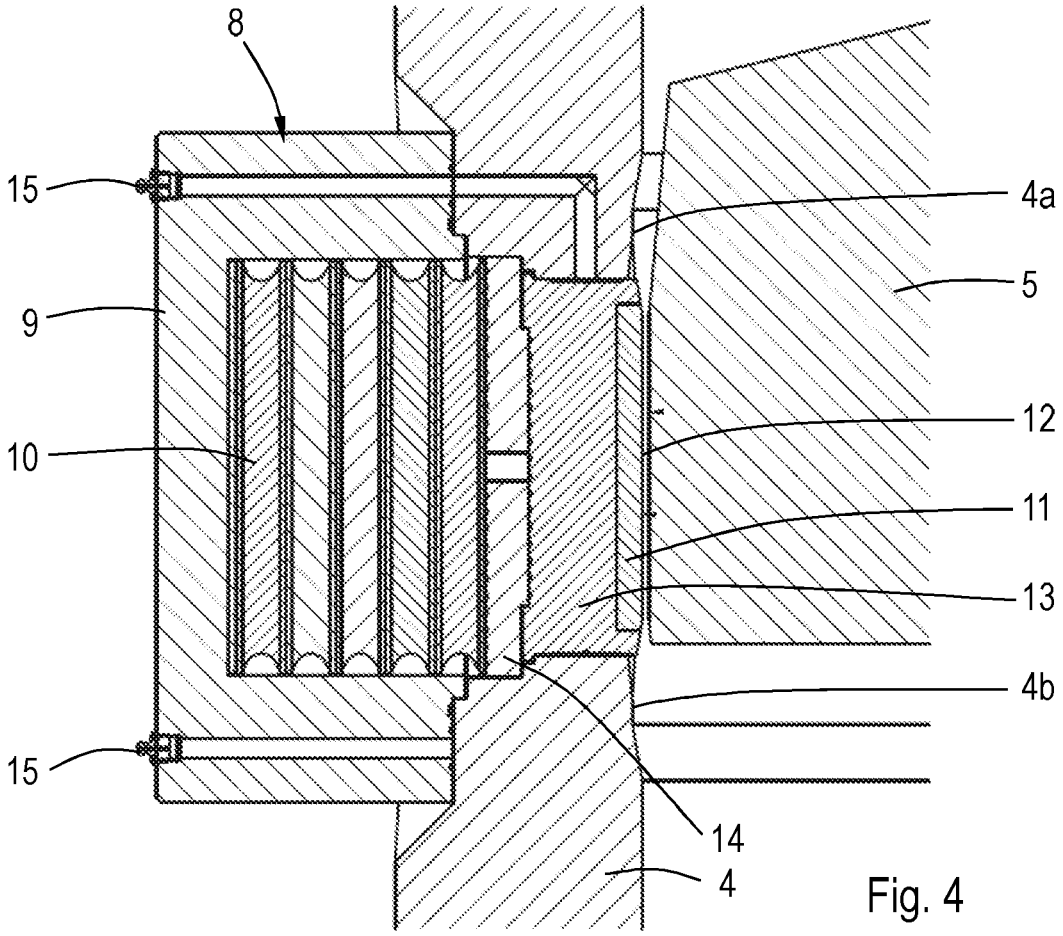
FIG. 4 is an enlarged cross-sectional view along the line IV-IV in FIG. 3, showing an anvil guide element.

FIGS. 2-4 show a part of the sleeve 4 where the anvil 5 is located. A plurality of discrete anvil guide elements 8 are mounted to the sleeve 4 and located at equal distances from each other in circumferential direction of the anvil 5 at a plane that extends perpendicular to the driving direction. Each of the anvil guide elements 8 has a housing 9 which is mounted to an outer side of the sleeve 4. In the embodiment as shown in the figures there are 16 anvil guide elements 8. The housing 9 accommodates a plurality of flexible discs 10, in this case five flexible discs 10, which are placed next to each other. The flexible discs 10, which may be made of an elastomer for example, have an elasticity including an elastic modulus which is smaller than the elastic modulus of the anvil 5 or of the sleeve 4 in transverse direction with respect to the driving direction at the location of the anvil 5.

Each of the anvil guide elements 8 is further provided with a rigid anvil guide block 11, which has an anvil guide surface 12. The anvil 5 and the sleeve 4 contact each other in the transverse direction through the anvil guide surface 12. The rigid anvil guide block 11 may be made of steel. It is fixed in an anvil guide block holder 13 which in turn is fixed to a stroke limiter 14. The stroke limiter 14 is sandwiched between the anvil guide block holder 13 and the flexible discs 10. Due to the elasticity of the flexible discs 10 the stroke limiter 14, the anvil guide block holder 13 and the rigid anvil guide block 11 are movable together in the transverse direction with respect to the sleeve 4. The displacement is limited by the stroke limiter 14 which is movable between opposite walls at the sleeve 4 and the housing 9, hence defining a maximum stroke of the anvil guide surface 12 with respect to the sleeve 4. The rigid anvil guide block 11 and the anvil guide block holder 13 pass through an opening in the sleeve 4 such that the anvil guide surface 12 is directed to the interior of the sleeve 4 and faces a circumferential surface of the anvil 5. FIG. 4 also shows nipples 15 for passing lubricant through a lubrication line towards a bearing between the anvil guide block holder 13 and the sleeve 4.

FIG. 4 shows that the inner wall of the sleeve 4 is provided with recesses 4*a*, 4*b* at portions of an inner wall thereof, which portions are adjacent to the anvil guide elements 8 in the driving direction, i.e. directly above and below the anvil guide block holder 13 in FIG. 4. The recesses 4*a*, 4*b* serve to allow the anvil 5 to reciprocatingly move with respect to the sleeve 4 under operating conditions and to allow the anvil 5 to only contact the anvil guide elements 8 in the transverse direction.

Figure 5:
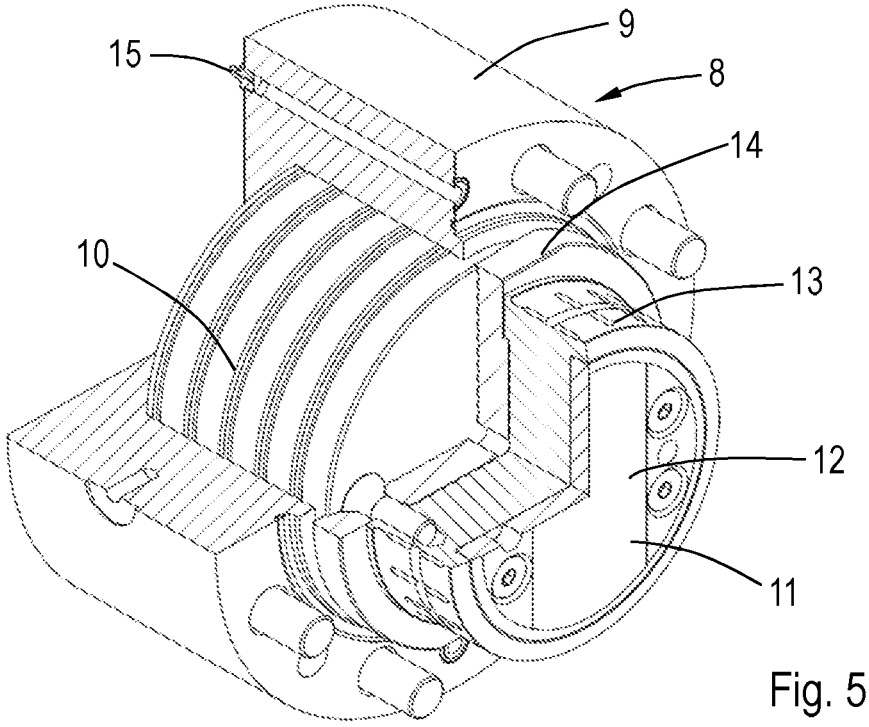
FIG. 5 is a perspective view of the anvil guide element as shown in cross-section in FIG. 4.

FIGS. 4 and 5 show that the anvil guide elements 8 are mounted to the sleeve 4 by fixing the housing 9 to the sleeve 4 from the outside. When one of the anvil guide elements 8 must be replaced or maintained the anvil 5 may remain within the sleeve 4.

FIGS. 6-13 show other parts which are mounted to the sleeve 4, illustrating another aspect of the invention, which is related to different types of pile guides for guiding a pile into the sleeve 4 before starting pile driving.

Figure 9:
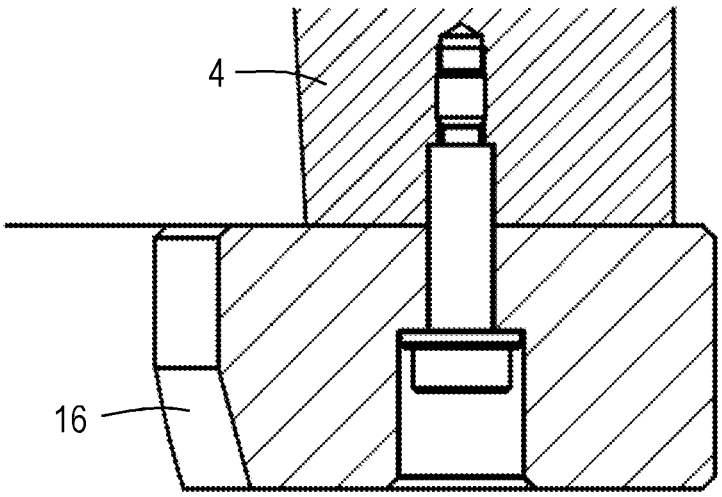
FIG. 9 is an enlarged sectional view along the line IX-IX in FIG. 3.
Figure 10:
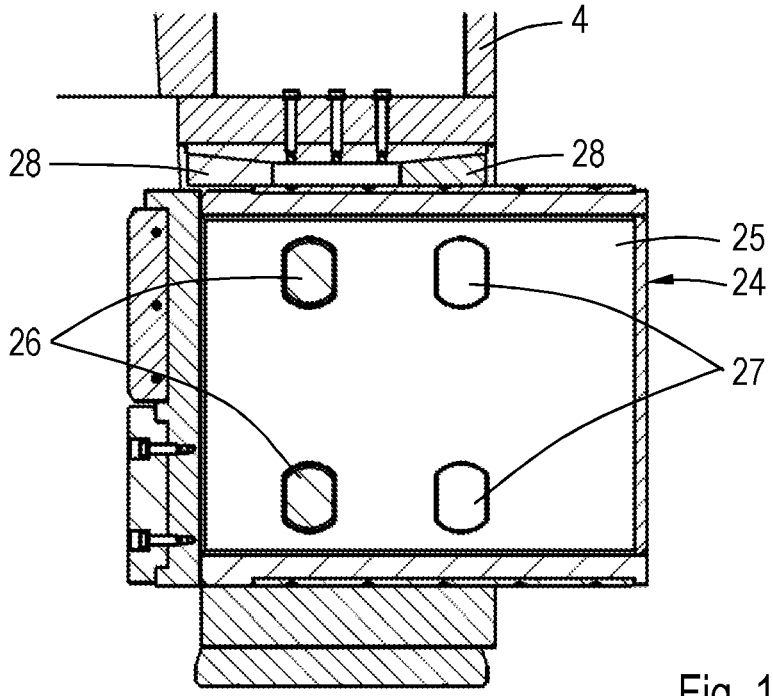
FIG. 10 is an enlarged sectional view along the line X-X in FIG. 3.
Figure 11:
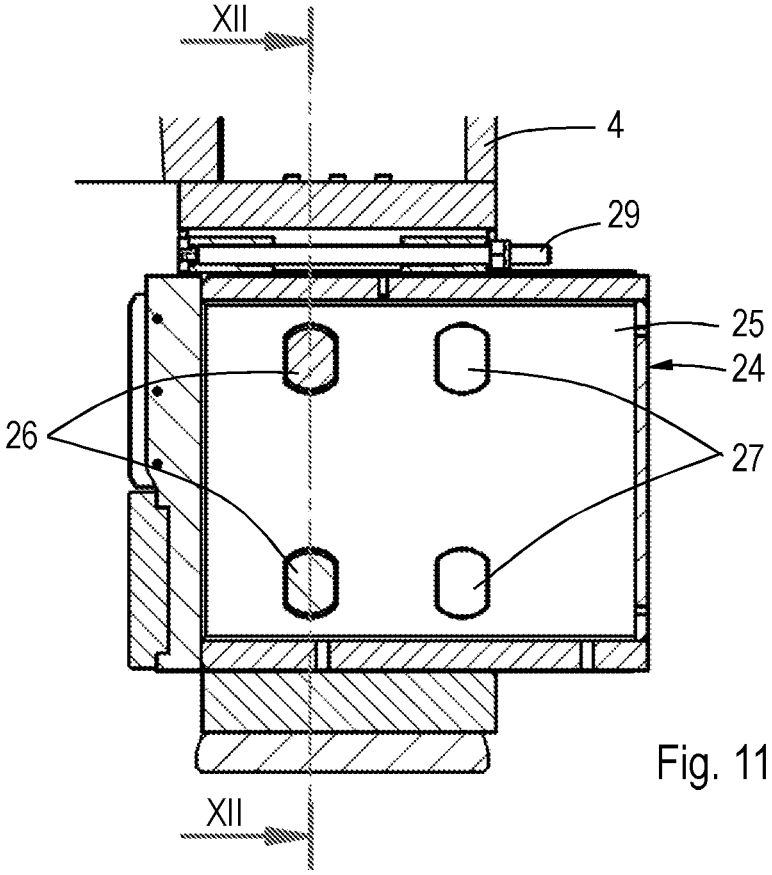
FIG. 11 is an enlarged sectional view along the line XI-XI in FIG. 3.
Figure 12:
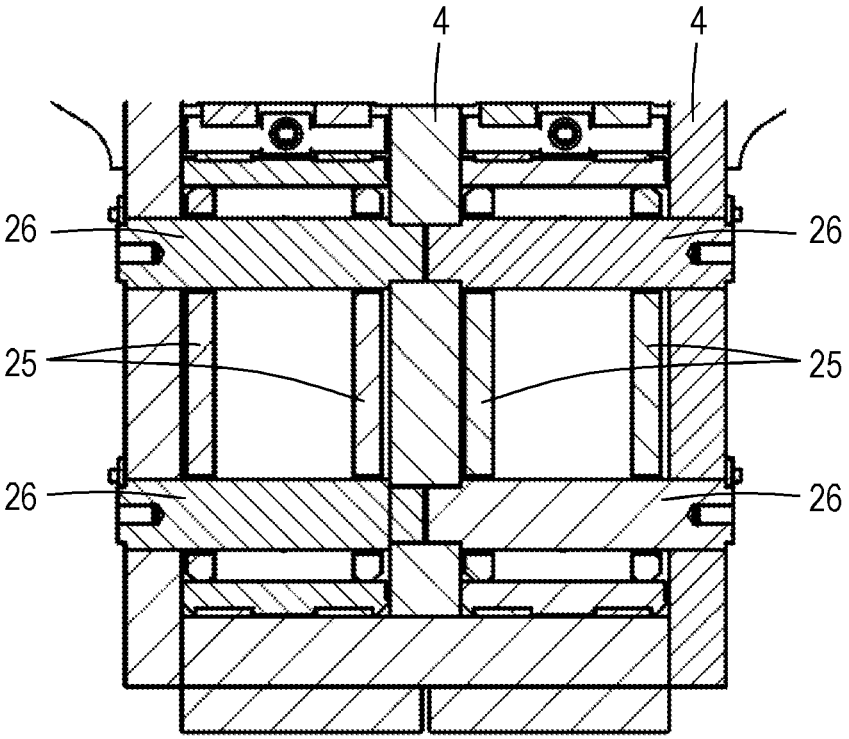
FIG. 12 is a sectional view along the line XII-XII in FIG. 11.
Figure 13:
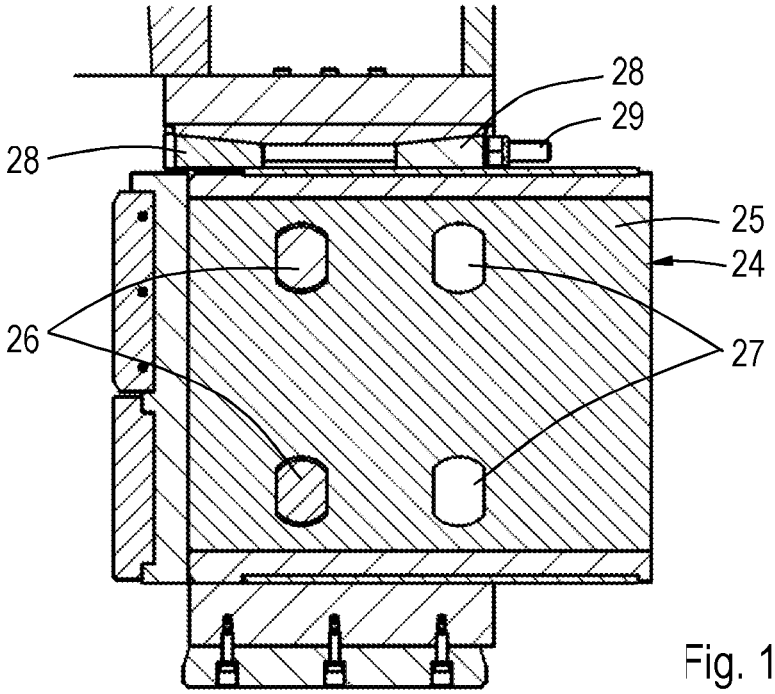
FIG. 13 is an enlarged sectional view along the line XIII-XIII in FIG. 3.

FIG. 9 shows one of a plurality of fixed pile guides 16 which are mounted to a lower end of the sleeve 4.

Figure 6:
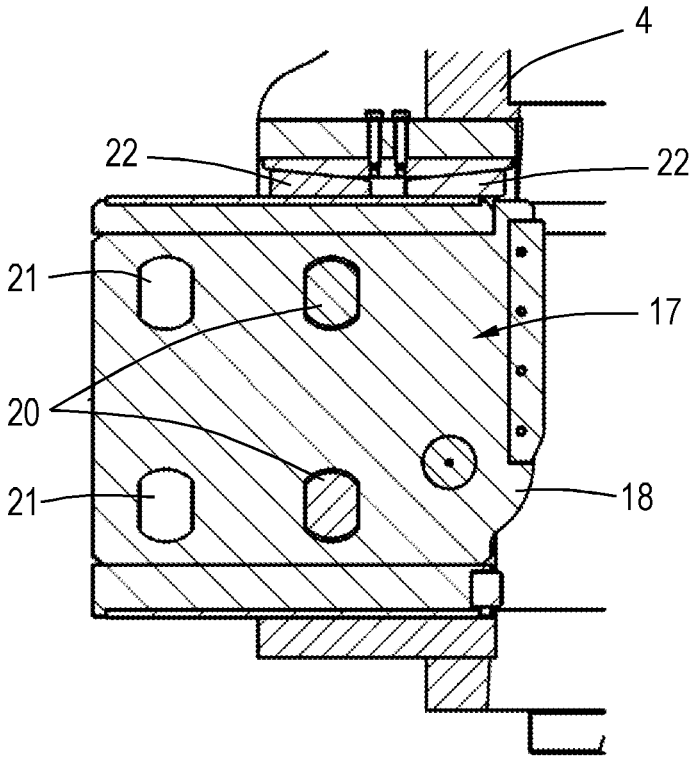
FIG. 6 is an enlarged sectional view along the line VI-VI in FIG. 3.
Figure 7:
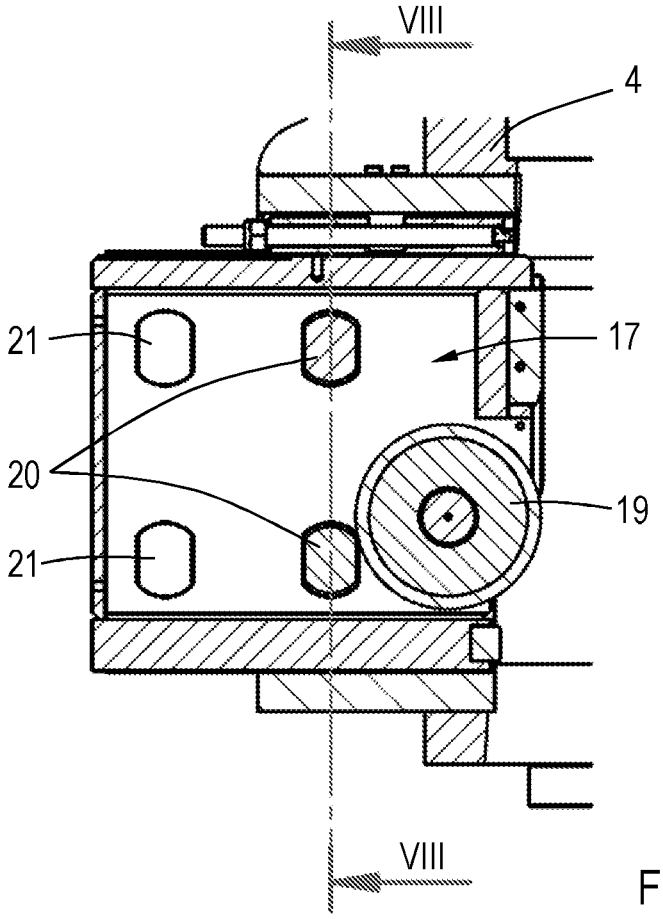
FIG. 7 is an enlarged sectional view along the line VII-VII in FIG. 3.
Figure 8:
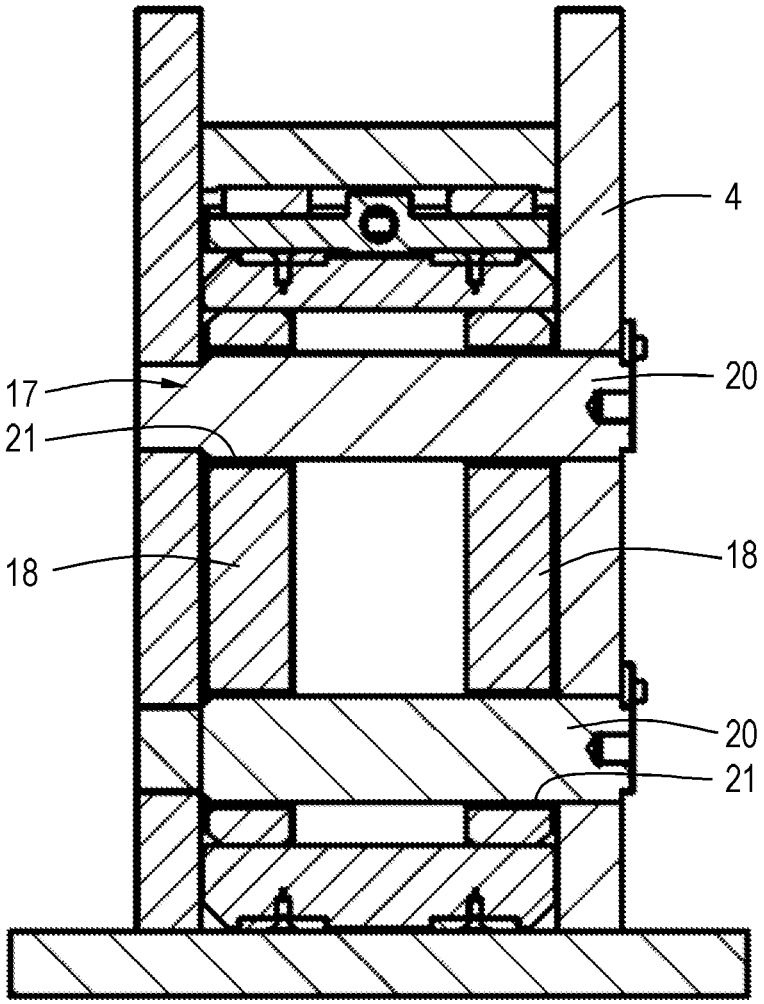
FIG. 8 is a sectional view along the line VIII-VIII in FIG. 7.

FIGS. 6-8 show one of first displaceable pile guide elements 17, which are located inside the sleeve 4 at a lower portion thereof. FIGS. 2 and 3 show that in this case there are eight first displaceable pile guide elements 17, but a different number may be applied in alternative embodiments. Each of the first displaceable pile guide elements 17 is displaceable with respect to the sleeve 4 in radial direction of its centerline CL. It has two parallel plates 18 between which a roller 19 is rotatably mounted. The plates 18 are releasably fixed to the sleeve 4 through pins 20 which pass through cooperating through-holes 21 in the plates 18. The plates 18 are provided with a number of through-holes 21 which are located at a distance from each other in radial direction of the centerline CL of the sleeve 4 such that the degree of protrusion of the plates 18 including the roller 19 within the sleeve 4 can be varied by putting the pins 20 in different through-holes 21. This provides the opportunity to adapt the positions of the first displaceable pile guide elements 17 in accordance with the diameter of a pile to be driven into the ground.

In order to prevent the plates 18 including the roller 19 from vibrating in a direction parallel to the centerline CL of the sleeve 4 each of the first displaceable pile guide elements 17 is provided with a blocking mechanism in the form of wedges 22 which are movable in radial direction of the centerline CL so as to allow blocking and releasing the first displaceable pile guide elements 17 with respect to the sleeve 4 in the driving direction. The wedges 22 are movable by means of a bolt 23 which can be turned from the outside of the sleeve 4 such that the blocking mechanism is operable from the outside of the sleeve 4.

FIGS. 10-13 show one of second displaceable pile guide elements 24, which are also called stabbing guides. In this case, there are two of these pile guide elements 24, see FIGS. 2 and 3, but a different number is conceivable. The second displaceable pile guide elements 24 protrude downwardly from the sleeve 4 at a lower end thereof. The positions of the second displaceable pile guide elements 24 at the sleeve 4 facilitate to place the sleeve 4 including the anvil 5 onto a pile under off-shore operating conditions. In practice, before starting a pile driving action, the sleeve 4 is lifted by a crane on a floating vessel to a height level where the second displaceable pile guide elements 24 are below the top of the pile but the main part of the sleeve 4 remains above the pile. Due to heave motion of the vessel the sleeve 4 is moving, as well. Under these conditions the sleeve 4 is first manoeuvred such that the second displaceable pile guide elements 24 contact the pile so as to center the sleeve 4 with respect to the pile before it is lowered. This functionality divides the centring and lowering operation in 2 phases instead of having to do these simultaneously, which is almost impossible in case of a floating vessel operating under severe weather conditions.

Similar as described above and shown in FIGS. 6-8 in relation to the first displaceable pile guide element 17, the second displaceable pile guide element 24 has plates 25, in this case two pairs of plates 25, which are releasably fixed to the sleeve 4 through pins 26 which pass through cooperating through-holes 27 in the plates 25. The second displaceable pile guide elements 24 are also provided with respective blocking mechanisms in the form of wedges 28 which are movable in radial direction of the centerline CL so as to allow blocking and releasing the second displaceable pile guide elements 24 with respect to the sleeve 4 in the driving direction. The wedges 28 are movable by means of a bolt 29 which can be turned from the outside of the sleeve 4 such that the blocking mechanism is operable from the outside of the sleeve 4.

Figure 14:
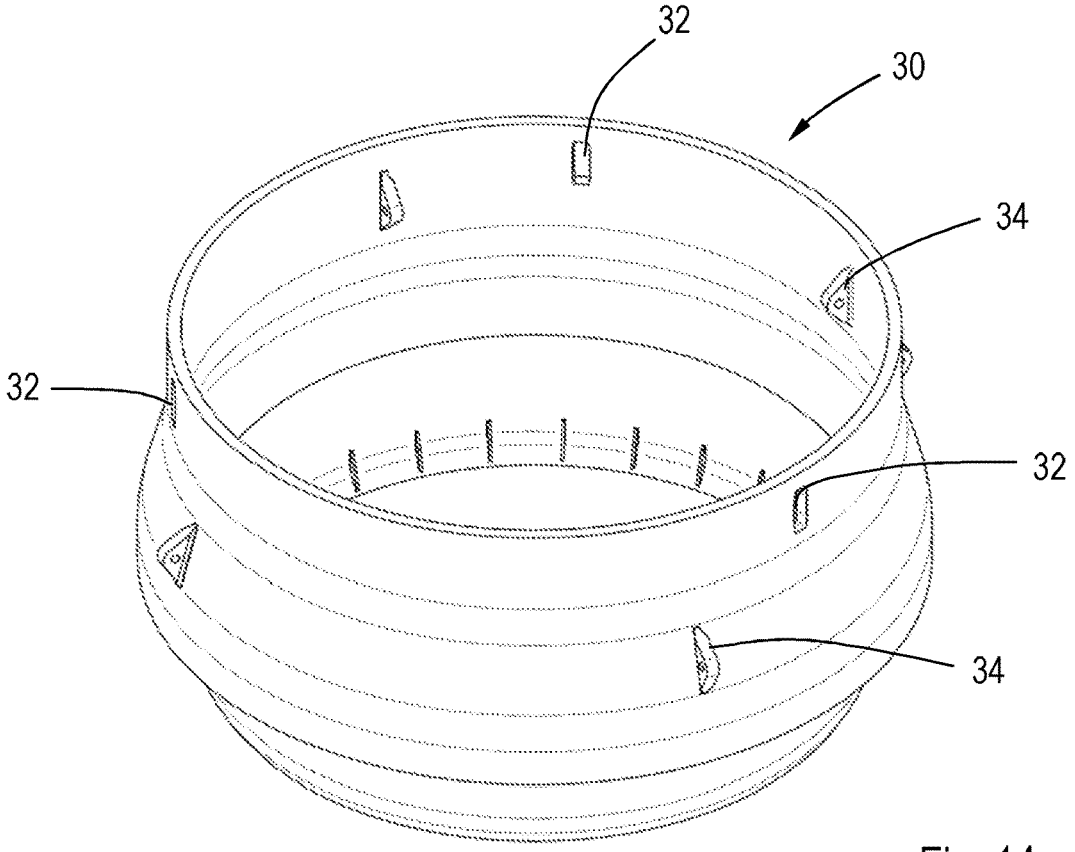
FIG. 14 is a perspective view of an embodiment of a follower according to an aspect of the invention.
Figure 15:
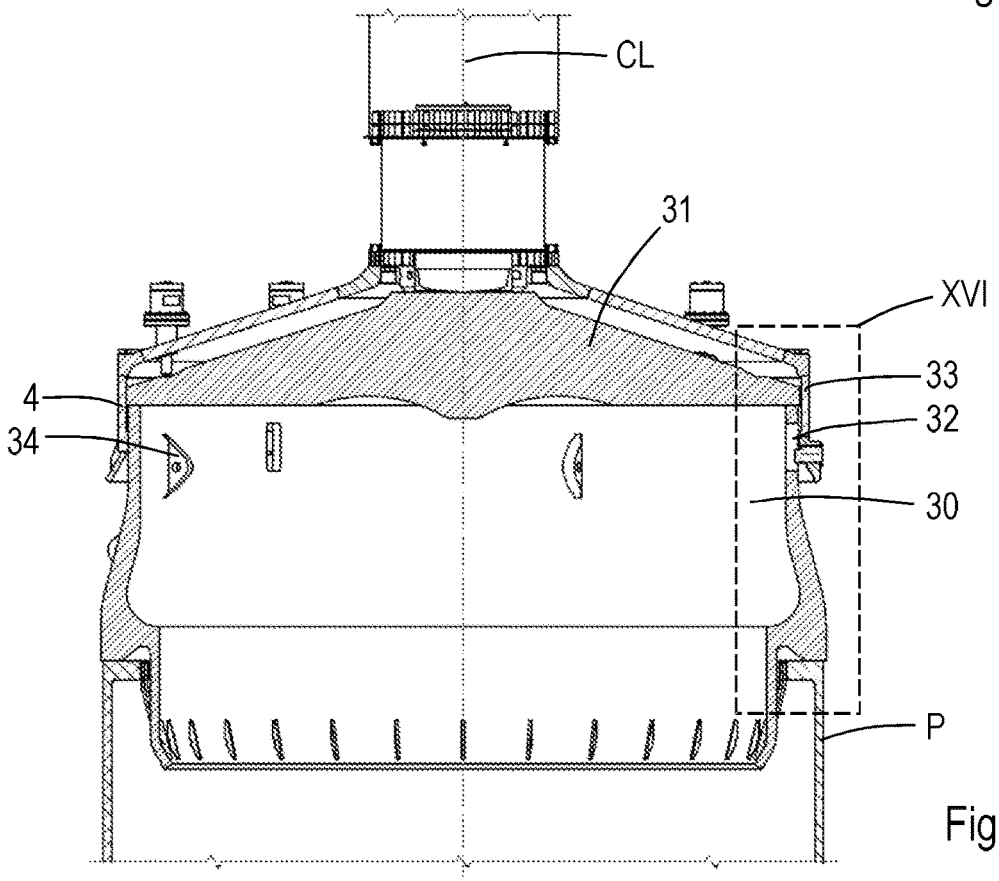
FIG. 15 is a cross-sectional view of the follower as shown in FIG. 14 in a configuration as used for driving a pile into the ground by means of a pile driving device.
Figure 16:
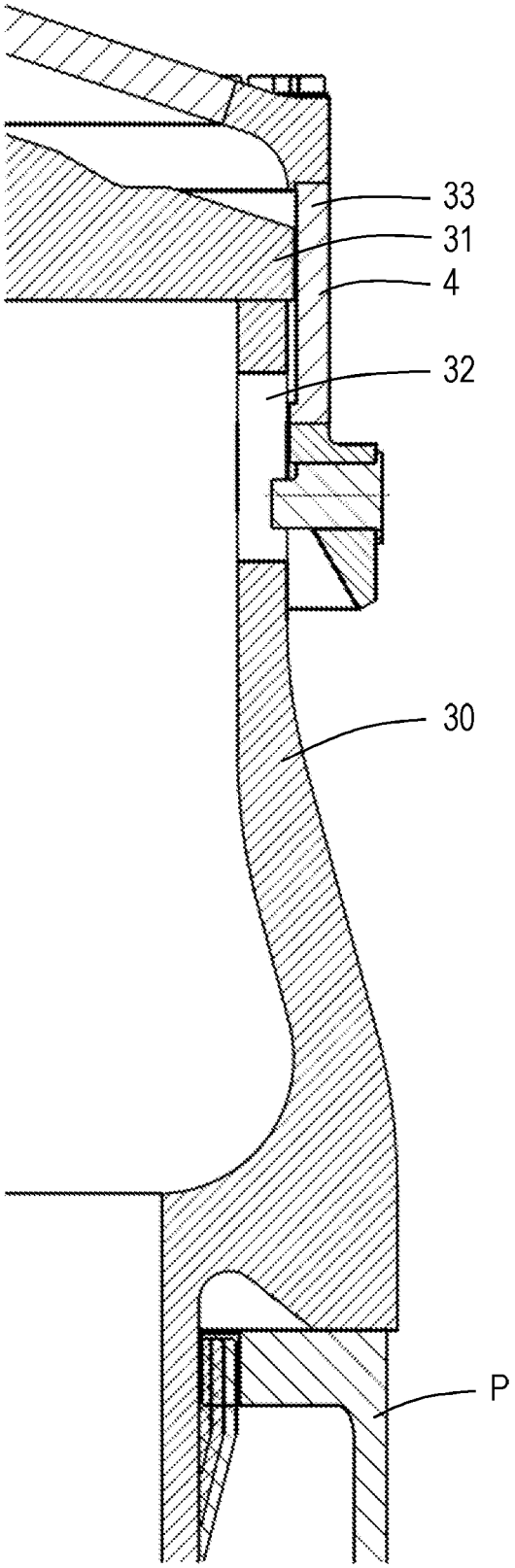
FIG. 16 is an enlarged part of FIG. 15 as indicated by XVI in FIG. 15.

FIG. 14 shows an embodiment of a tubular follower 30 according to another aspect of the invention. FIGS. 15 and 16 show the follower 30 in a situation under operating conditions. The follower 30 is located on top of a pile P to be driven into the ground, whereas a portion of the follower 30 protrudes into the pile P. An anvil 31 is placed on an upper end of the follower 30. As shown in FIG. 15 the outer diameter of the pile P is larger than the outer diameter of the anvil 31, whereas the follower 30 bridges the difference of the diameters. It is also possible to bridge the difference of the diameters by introducing an anvil ring (not shown) instead of the follower or in addition to the follower.

The follower 30 is provided with three stress relieve slots 32. Each of the stress relieve slots 32 has a longitudinal direction that is parallel to the driving direction or a centerline of the follower 30, which centreline coincides with the centerline CL of the sleeve 33. The stress relieve slots 32 are located in an upper portion of the follower 30 and are located at equiangular distance about the centerline of the follower 30. In an alternative embodiment the number of stress relieve slots 32 may be different. The stress relieve slots 32 serve to minimize deformations of the follower 30. Besides, they can be used for lifting the follower 30, possibly together with the anvil 31 and the sleeve 33. The embodiment as shown in FIG. 14 is also provided with projecting lifting lugs 34 at the inner side and the outer side of the follower 30.

Figure 17:
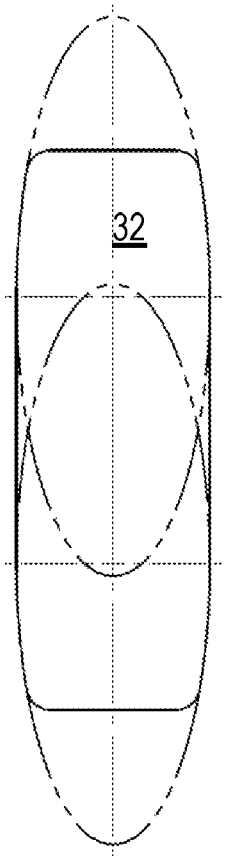
FIG. 17 is a frontal view of a part of the follower as shown in FIGS. 14-16, showing a stress relieve slot.

Each of the stress relieve slots 32 has opposite longitudinal walls which are concave. This means that the distance between the longitudinal walls is larger at a distance from upper and lower ends of the slot 32. This shape appears to be very effective in terms of minimizing structural stress peaks in the follower 30. At least a section of each longitudinal wall may coincide with a section of an ellipse. FIG. 17 shows one of the slots 32 on a large scale wherein portions of each of the longitudinal walls coincide with portions of two ellipses which are aligned in their longitudinal directions. It is also possible that the whole edge of the slot 32 is shaped as a full ellipse; this is illustrated in an alternative embodiment in FIG. 18.

Figure 18:
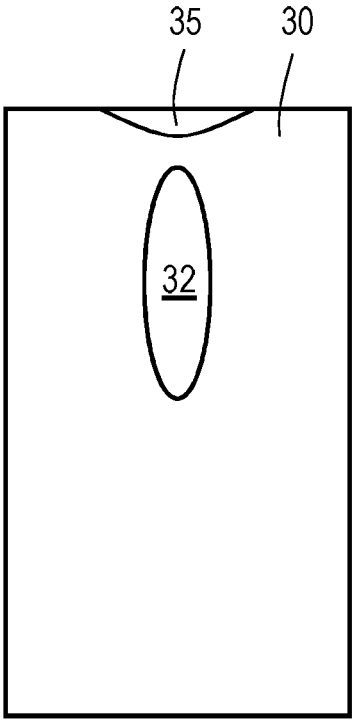
FIG. 18 is an illustrative side view of a part of an alternative embodiment of the follower.

A further improvement of reducing structural stress peaks is achieved by sunken portions 35 at an upper rim of the follower 30 at positions where the stress relieve slots 32 are located. This is illustrated in FIG. 18 in which the size of one of the sunken portions 35 is exaggerated. The upper rim of the follower 30 is located at an upper side of the follower 30 under operating conditions, which upper rim receives impact energy from the anvil 31 under operating conditions.

The invention is not limited to the embodiments shown in the drawings and described hereinbefore, which may be varied in different manners within the scope of the claims and their technical equivalents. For example, the anvil guide element may be a flexible block which is mounted to the sleeve.

The invention claimed is:

1. A pile driving device for driving a pile into the ground, comprising a ram, an anvil and a sleeve, wherein the anvil is accommodated in the sleeve and movable with respect to the sleeve in a driving direction, wherein the ram is reciprocatingly movable with respect to the anvil in the driving direction so as to provide impact energy to the anvil under operating conditions, wherein the anvil and the sleeve contact each other in a transverse direction of the driving direction through an anvil guide surface of an anvil guide, being a separate anvil guide that is mounted to one of the anvil and the sleeve such that the anvil guide surface is movable with respect to said one of the anvil and the sleeve in the transverse direction.

2. The pile driving device according to claim 1, wherein the anvil guide comprises an elasticity for allowing the anvil guide surface to move, which elasticity has an elastic modulus which is smaller than an elastic modulus of the anvil or of the sleeve in the transverse direction at a location of the anvil.

3. The pile driving device according to claim 1, wherein the anvil guide surface is part of a rigid anvil guide body, which is resiliently mounted to said one of the anvil and the sleeve.

4. The pile driving device according to claim 1, wherein the anvil guide is a discrete anvil guide element, wherein one or more of such discrete anvil guide elements are located at a distance from each other in a circumferential direction of the anvil.

5. The pile driving device according to claim 1, wherein the anvil guide is mounted to the sleeve such that the anvil guide surface is movable with respect to the sleeve in the transverse direction.

6. The pile driving device according to claim 5, wherein a further anvil guide is mounted to the anvil such that the further anvil guide is movable with respect to the anvil in the transverse direction, wherein the further anvil guide has similar functional characteristics as the anvil guide.

7. The pile driving device according to claim 1, wherein the sleeve is provided with a pile guide element configured to guide a pile to be driven into the ground, which pile guide element is displaceable with respect to the sleeve in the transverse direction of the driving direction so as to vary a rate of protrusion of the pile guide element within the sleeve.

8. The pile driving device according to claim 7, wherein the pile driving device comprises a blocking mechanism configured to block the pile guide element with respect to the sleeve in the driving direction.

9. The pile driving device according to claim 8, wherein the blocking mechanism is provided with a wedge, which is movable in the transverse direction so as to allow blocking and releasing of the pile guide element with respect to the sleeve in the driving direction.

10. The pile driving device according to claim 8, wherein the blocking mechanism is operable from the outside of the sleeve.

* * * * *